US005202664A

United States Patent [19]

Poulsen

[11] Patent Number: 5,202,664

[45] Date of Patent: Apr. 13, 1993

[54] THREE PHASE TRANSFORMER WITH FRAME SHAPED WINDING ASSEMBLIES

[76] Inventor: Peder U. Poulsen, Huntington Rd. Box 197, Stratford, Conn. 06497

[21] Appl. No.: 826,608

[22] Filed: Jan. 28, 1992

[51] Int. Cl.[5] ..... H01F 27/08; H01F 27/30

[52] U.S. Cl. ..... 336/5; 336/60; 336/213; 336/223; 336/225

[58] Field of Search ..... 336/5, 10, 12, 60, 96, 336/183, 213, 223, 228, 214, 215, 205

[56] References Cited

U.S. PATENT DOCUMENTS

| | | | |
|---|---|---|---|
| 3,617,965 | 11/1971 | Trench | 336/213 |
| 4,234,862 | 11/1980 | Prerotat | 336/5 |
| 4,588,971 | 5/1986 | Beisser | 336/213 |
| 4,639,705 | 1/1987 | Beisser | 336/215 |
| 4,906,960 | 12/1990 | Alexandrov | 336/213 |

FOREIGN PATENT DOCUMENTS

| | | | |
|---|---|---|---|
| 2225820 | 11/1974 | France | 336/5 |
| 481568 | 6/1953 | Italy | 336/5 |
| 557679 | 6/1978 | U.S.S.R. | 336/215 |
| 499010 | 1/1939 | United Kingdom | 336/213 |

*Primary Examiner*—Thomas J. Kozma
*Attorney, Agent, or Firm*—John H. Crozier

[57] ABSTRACT

A three phase transformer, e.g. a distribution transformer comprising three, substantially identical, frame shaped winding assemblies each containing primary and secondary windings which together form half legs having substantially semicircular cross section. The winding assemblies are placed together to form a triangular structure, so called temple configuration, wherein the half legs of adjacent winding assemblies combine into three legs having substantially circular cross section. A magnetic circuit is formed around each leg by winding a continuous strip of a ferromagnetic sheet material around the leg.

5 Claims, 1 Drawing Sheet

THREE PHASE TRANSFORMER WITH FRAME SHAPED WINDING ASSEMBLIES

The present invention relates to three phase electrical transformers in general and more specifically to three phase distribution transformers which are used for stepping down voltage at user locations along a power line.

Transformers generally contain two or more electrical circuits, primary and secondary windings, consisting of multiturn coils of electrical conductors which are interlinked by means of one or more magnetic circuits or cores.

Traditionally cores consist of a plurality of ferromagnetic laminations which are stacked together to form a closed loop, surrounding and coupling magnetically the primary and secondary windings. Cores may be manufactured either from mutually overlapping or abutting individual laminations or from a continuous strip of magnetic sheet material which is wound around a mandrel to form a closed circuit. The magnetic and electric circuits are combined either by assembling the cores around pre-wound primary and secondary coils, or by winding the conductor coils around one or more legs of the closed magnetic circuit. Another way of interlinking the circuits is to wind a continuous strip of magnetic material through the pre-wound electric coils to form one or more magnetic core segments which surround parts of the primary and secondary windings.

Prior art describes numerous variations of the basic principle outlined in the above, all aiming towards producing and combining the circuits with a minimum of labor, and at the same time optimizing the usage of conductor and core material in order to improve economy and minimize magnetic and electrical losses. One way of shortening either the electric or the magnetic path is to use circular coils surrounding substantially circularly sectioned core legs, or a wound core which surrounds primary and secondary windings having a total, substantially circular cross section.

Single phase transformers employing the latter principle are described in U.S. Pat. Nos. 2,160,589 2,314,912 and 4,906,960 which all relate to transformers wherein cores or core segments are formed by winding a continuous magnetic strip around the legs of pre-wound primary and secondary coil assemblies.

U.S. Pat. No. 2,401,952 relates to a three phase transformer with a core structure consisting of three identical segments, each segment being manufactured from several continuous strips of core material with different width which are wound around a rectangular mandrel. To form a three phase core the segments are assembled in so called temple arrangement wherein one leg of each segment combines with that of another to form a stepped cross section with a substantially circular shape. A conductor winding assembly is wound onto a circular coil form surrounding each of the combined core legs.

German Auslegeschrift No. 1 011 056 describes a related core structure wherein each of the identical core segments is manufactured by winding two continuous strips of core steel, one upon the other, around a rectangular mandrel. The combination of a constant width strip which is wound to form a rhombic part section and a tapered strip forming a triangular part section produces a combined trapezoidally shaped cross section of each frame leg. When set up in temple configuration each of the three legs will have cross section shaped substantially like a regular hexagon fitting into a circular coil assembly with good space factor. German Offenlegungsschrift No. 27 02 455 describes an even closer approximation to a circular cross section of the combined core legs by employing a plurality of tapered, continuous strips in each frame segment.

It is a common drawback of the three temple cores described in the above that the winding of the frame sections and taper slitting of multiple strips is quite labor demanding. In addition the conductor winding assemblies must be wound around the core legs into the closed structure and this is usually done by rotating split bobbins around the legs. The winding is impeded by protruding terminals an taps and is a difficult and time consuming process which is not easily mechanized. Furthermore the core designs are poorly suited for amorphous core material which is difficult to slit and would require extensive clamping and supporting means in order to maintain the shape of the core segments during fabrication and later on in the completed transformer.

The three phase transformer of the invention bears a certain resemblence with the described prior art by suggesting a perfectly symmetrical temple structure with an improved core-coil space factor. Contrary to the prior art, however, the 1 invention does not require slitting of multiple widths or taper slitting of core material, and the coil assemblies may be pre-wound and combined with the core sections in a simple, easily mechanized procedure. Furthermore, a transformer according to the invention is ideally suited for amorphous core material because each core section is wound from a constant width strip and shaped like a hollow cylinder which may be supported vertically resting on one end eliminating the need for clamping means.

A preferred embodiment of the invention will be described in the following with reference to the drawings, in which

The Drawings

Figure 1:
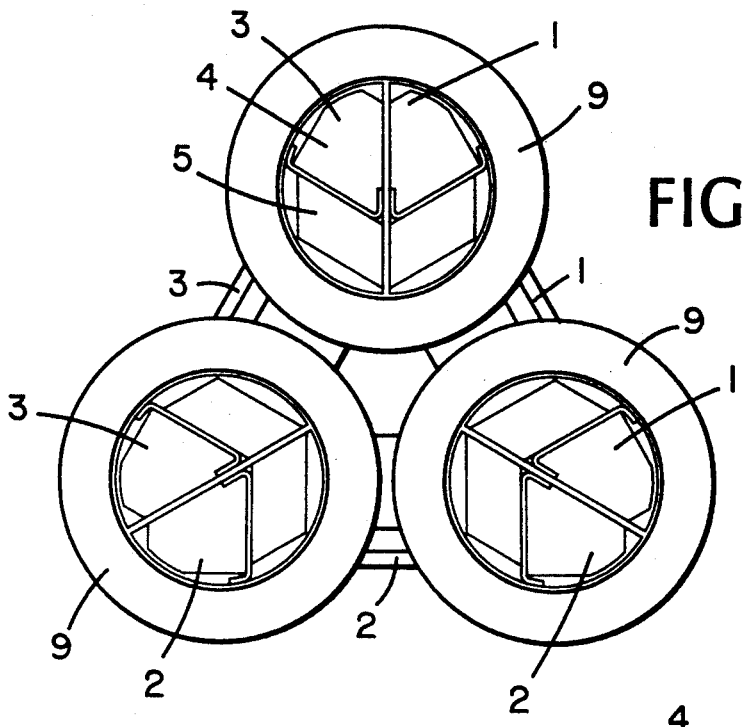
FIG. 1 is a cross section through a transformer according to the invention.

The transformer illustrated in the drawings could represent a distribution transformer containing three, substantially identical winding assemblies, 1-1, 2-2 and 3-3 each comprising a high voltage primary winding 4 and a low voltage secondary winding 5, the two windings being insulated between each other by means of a suitable dielectric 6.

The assemblies are produced by winding the conductors around a rectangular mandrel with rounded corners on a coil winding machine containing suitable means for guiding and laying the conductors down in a precise and orderly manner.

In the shown embodiment of the invention the first winding to be applied is the low voltage secondary 5, which consists of foil or strip of copper or aluminum and is laid down one layer to a turn interleaved with a suitable layer insulation such as e.g. dielectric paper or polyester film. During the winding process the conductor is gradually advanced paralell with the mandrel axis to form a coil with a rhombic cross section having 60 and 120 degrees corner angles.

After laying down the required number of turns the conductor is terminated and insulation 6 is placed on top of the winding, overlapping at both sides, the overlapping parts to be folded down later after the winding of the high voltage primary 4.

In the illustrated transformer the primary 4 is wound with rectangular wire, and because of the requirement for additional interlayer insulation, its space factor is considerably poorer than that of the secondary winding. For this reason and because the conductor cross section has been adjusted to compensate for taking the longer track near the outside of the assembly, the high voltage winding occupies a considerably larger cross sectional area than the low voltage winding.

Figure 2:
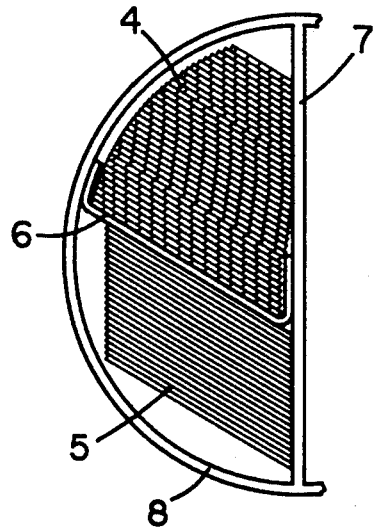
FIG. 2 is a cross section through one half leg of a winding assembly according to the invention showing the winding arrangement in greater detail.
Figure 3:
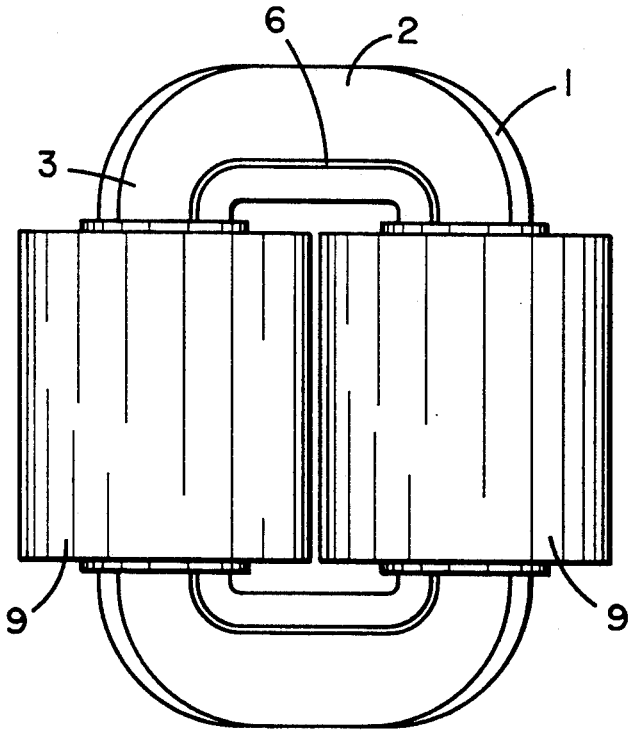
FIG. 3 is a side view of a transformer according to the invention.

During the winding of the primary the wire guide is advanced back and forth across the field to produce, as the layers build up, a cross section substantially as shown in FIG. 2, with the objective of filling, with good space factor the remainder of the semicircular space available.

After termination of the high voltage winding the main insulation 6 is folded up and down at the edges and the shape secured by means of bandaging and taping of legs and yokes whereafter the assembly may be removed from the winding mandrel.

At this stage, if it is desired, the individual assemblies may be molded into a jacket of a suitable electrical resin to be used in a dry-type transformer or they may be used as is in an oil filled unit. As the next manufacturing step the assemblies are placed together in the temple configuration and secured by bandaging, and in the process flat insulation sheets 7 may be inserted between the half legs to insulate the assemblies from one another.

In the case of an open, unmolded winding, at this point a tube 8 of a flexible dielectric like e.g. laminated glass fibre may be mounted around each leg and secured in place by means of e.g. electrical tape or resin, the tube serving the double purpose of providing additional winding insulation and a well defined cylindrical surface of each leg.

After the completion of the temple shaped coil structure the next step is the winding of cylindrical cores 9 around each of the circular legs using a suitable ferromagnetic material like e.g. grain oriented silicon steel or amorphous steel. In both cases cores are pre-wound into the desired shape and stress relief annealed in order to restore the original magnetic properties of the core material.

After annealing, the core cylinders are transferred to the temple structure by overwinding onto the cylindrical legs and during this process it is important to not exceed the elastic limits of the strip material which would re-introduce mechanical stress and again reduce the magnetic quality of the cores. The patent literature describes several ways of mechanizing this procedure using belts or rollers to rotate the core around the stationary leg as the diameter builds up.

During the winding process the original configuration of the core is maintained, i.e. by taking the material up from the inside of the annealed core as it is wound onto the leg. This process is described in European Patent Application No. 83 300 004.5, Jan. 4 1983. An alternate way would be the overwinding of the core inside out onto an auxiliary mandrel and then transferring it to the leg while taking the material from the outside.

Transferring the core cylinders to the legs can either be done one by one, or all three at the same time by means of three core winding machines placed at mutual 120 degree angles. After the securing of the last turn the only remaining step is hooking the transformer up and placing it in a tank or other enclosure with the core assembly resting on a sheet of insulating material and the cores resting on end upon bars or other structure suited to accept the weight without undue re-introduction of mechanical stress.

Because the above mentioned support means are not part of the invention they are not shown on the drawings, and many variations hereof are possible without affecting the scope of the invention.

Also the subject matter represented by the drawings and specification is only one version of a transformer according to and defined by the invention. Since many changes may be made in the above construction without departing from the scope of the invention, it is intended that all matter contained in the above description or shown in the accompanying drawings shall be interpreted as illustrative and not limiting.

It is also understood that the following claims are intended to cover all of the generic and specific features of the invention herein described, and all statements of the scope of the invention which, as a matter of language, might be said to fall therebetween.

What is claimed is:

1. Three phase transformer comprising three substantially identical frame shaped winding assemblies, each containing low voltage and high voltage windings insulated between each other, and forming together half legs of substantially semi-circular cross section, said winding assemblies being placed together to form a triangular structure wherein the half legs of adjacent assemblies combine into three legs of substantially circular cross section, said winding assemblies being interlinked by three hollow, cylindrical cores wound from ferromagnetic strip material, each core surrounding one of said substantially circular legs and wherein each winding assembly contains said low voltage winding having rectangular turns of uniform width, with each turn placed upon the previous turn in a staggered fashion to form together a rhombordly shaped part section, and said high voltage winding wound several turns to a layer, the layers being of varying width and offset mutually to form an offset part section, said rhomboidly shaped part section and said offset part section forming said semi-circular cross section of each of said half legs.

2. Transformer according to claim 1, wherein the magnetic cores are installed on the legs by rewinding previously wound and heat treated cylindrical cores onto said substantially circular sectioned legs.

3. A three phase transformer according to claim 1 wherein each winding assembly is molded into a rigid.. frame by means of solid electric insulating resin.

4. A three phase transformer according to claim 1 or 4, wherein the flat faces of adjacent winding assemblies are placed sufficiently apart to form passages for cooling fluid along the diametrical planes.

5. A three phase transformer according to claim 1, wherein the combined winding assemblies are molded into a single, rigid three legged structure by means of a solid electric insulating resin.

* * * * *